US008561356B2

(12) United States Patent
Chuang

(10) Patent No.: US 8,561,356 B2
(45) Date of Patent: Oct. 22, 2013

(54) PANEL ASSEMBLY AND ACCESSORIES

(76) Inventor: Ming-Ching Chuang, Kaohsiung (TW)

( * ) Notice: Subject to any disclaimer, the term of this patent is extended or adjusted under 35 U.S.C. 154(b) by 0 days.

(21) Appl. No.: 13/354,901

(22) Filed: Jan. 20, 2012

(65) Prior Publication Data

US 2012/0117910 A1 May 17, 2012

Related U.S. Application Data

(63) Continuation-in-part of application No. 12/144,899, filed on Jun. 24, 2008, now abandoned.

(51) Int. Cl.
*E04B 2/74* (2006.01)

(52) U.S. Cl.
USPC ..... 52/36.5; 52/36.6

(58) Field of Classification Search
USPC ..... 52/36.5, 36.6; 211/85.1, 87.01; 248/225.11, 222.51
See application file for complete search history.

(56) References Cited

U.S. PATENT DOCUMENTS

| | | | | | |
|---|---|---|---|---|---|
| 4,211,331 | A | * | 7/1980 | Salmon et al. | 211/85.1 |
| D270,219 | S | * | 8/1983 | Elias | D6/458 |
| 4,420,087 | A | * | 12/1983 | Johns | 211/189 |
| 4,932,538 | A | * | 6/1990 | Gambello | 211/87.01 |
| 5,477,969 | A | * | 12/1995 | Beeskau et al. | 211/90.02 |
| 5,941,026 | A | * | 8/1999 | Eisenreich et al. | 52/36.5 |
| 6,575,314 | B2 | * | 6/2003 | Lung et al. | 211/163 |

* cited by examiner

*Primary Examiner* — Basil Katcheves
(74) *Attorney, Agent, or Firm* — Rosenberg, Klein & Lee

(57) ABSTRACT

A panel assembly includes multiple base boards, multiple cover panels, multiple shelves and multiple accessories so as to be fixed to a wall. The multiple base boars and the multiple cover panels define a path, a space and a gap. The path, the space and the gap communicate with each other. Sand the shelves or the accessories are inserted into the path, the space and gap. The panel assembly can be quickly assembled and replaced to change the arrangements and suitable for decoration and display or storage.

18 Claims, 16 Drawing Sheets

PANEL ASSEMBLY AND ACCESSORIES

This application is a continuation in part of my application filed Jun. 24, 2008, Ser. No. 12/144,899, currently pending.

FIELD OF THE INVENTION

The present invention relates to a panel assembly and the accessories thereof, and more particularly, to a panel assembly suitable for decoration, display and storage.

BACKGROUND OF THE INVENTION

A conventional panel assembly sued in decoration uses a cover panel fixed to the base directly and the cover panel is difficult to be removed from the base for replacement conveniently. When the users want to change or replace the patterns on the cover panel, both of the cover panel and the base are need to be replaced and this is a time consuming task and significant material will be discarded. Furthermore, the removal of the cover panel and the base may damage the structure next to the working site.

U.S. Pat. Nos. 4,063,393, 4,114,247, 4,913,576 and 5,623,800 disclose some of the panel assemblies which are classified in the international catalog E04F19/06. However, the cited references cannot provide solutions for quickly replacement of the decoration panels, storage panels, and display panels.

Applicant filed U.S. patent application Ser. No. 12/144,899 and the Examiner cited U.S. Pat. No. 6,601,349 to reject the application. The U.S. Pat. No. 6,601,349 discloses a panel assembly which cannot be directly fixed to the wall and has to be connected to special-designed racks so that the panels can be arranged upright. Nevertheless, when assembling the racks and the panels, the panels cannot be quickly disengaged from the racks. Besides, the panels have multiple holes whose positions are fixed so that when the panels have to be shifted or connected to different ways, the holes of the panels that to be connected cannot be in alignment with each other. Therefore, the inherent problems are not solved.

The present invention intends to provide a panel assembly for decoration and there are gaps between panels for installation of accessories so as to improve the shortcomings of the conventional panel assemblies.

SUMMARY OF THE INVENTION

The present invention relates to a panel assembly and comprises multiple base boards, multiple cover panels, multiple shelves and multiple accessories so as to be fixed to a wall. The multiple base boars and the multiple cover panels define a path, a space and a gap. The path, the space and the gap communicate with each other. Sand the shelves or the accessories are inserted into the path, the space and gap. The panel assembly can be quickly assembled and replaced to change the arrangements and suitable for decoration and display or storage.

Preferably, two adjacent sides of the rectangular walls are in flush with two adjacent sides of the base boards. The cover panels are exposed from the other two adjacent sides of the base boards and the rectangular walls, the cover panels and the rectangular walls of the adjacent base boards define the path.

Preferably, the thickness of the cover panel is smaller than a thickness of the rectangular wall.

Preferably, the first and second connection members have connection holes and resilient latches.

Preferably, the first and second connection members have positioning ribs.

Preferably, the first and second connection members have a positioning rod and a positioning hole.

Preferably, the rectangular wall has a hollow portion and a fixing unit is located in the hollow portion and connected to the rectangular wall. The fixing unit has more than one fixing holes, the first connection member is located a conjunction portion between the rectangular wall and the hollow portion.

Preferably, the fixing unit has a fixing member and multiple connectors which are connected to the fixing member and extend to the rectangular wall. The fixing member and the connectors each have a reinforcement rib. The fixing hole is located at the center of the fixing member. The fixing unit has a curved surface whose highest point is located at the fixing hole.

Preferably, the multiple base boards are fixed to each other.

Preferably, the multiple base boards are formed integrally or glued to each other.

Preferably, the multiple base boards are assembled to each other.

Preferably, the second connection member of the face panel is located corresponding to one of the first connection member.

Preferably, the second connection member of the face panel is located corresponding to the first connection members.

Preferably, each of four corners of the rectangular wall has a notch.

Preferably, a shelve is inserted into the gap and the path.

Preferably, the cover panel has a face facing the second connection member has patterns and drawings or is colored.

Preferably, the gap between the adjacent upper and lower cover panels is shifted a distance from the path between the adjacent upper and lower rectangular walls.

Preferably, a block has a threaded hole and two side wings. The block is located between the gap and the path, and the side wings are located in the space.

Preferably, the panel assembly has an accessory which has a first accessory portion, a second accessory portion and a third accessory portion. An included angle of 90 degrees is defined between the first accessory portion and the second accessory portion. The second accessory portion is connected to the third accessory portion. The first accessory portion contacts the cover panel. A rod extends from one side of the first accessory portion. The second accessory portion is located in the gap and the path. The third accessory portion contacts the rectangular wall. The second accessory portion has a protrusion located in the space.

The primary object of the present invention is to provide a panel assembly which can be increased or reduced or replaced within short period of time. By assembling different sizes of panels and arranging different types of arrangements, different gaps can be defined so that shelves and accessories are connected to the panel assembly.

The panel assembly of the present invention is easily to be assembled and replaced, and the change of the panel assembly is flexible.

The panel assembly of the present invention is suitable for Do-It-Yourself type decoration purposes, especially for display decoration, residential decoration, commercial decoration, storage decoration or wall decoration.

By combination of different sizes and material of the panels, the results for decoration can be varied which meet different needs.

Multiple cover panels and base boards define cross-shaped paths with which the objects and accessories are inserted and the panel assembly bears loads.

The panels can be fixed to any surface such as wall, cabinet, closet or racks.

The panels are able to be cooperated with different types of accessories to provide multiple functions.

The panels can be machined secondarily and re-used.

The panels are modularized and environmental friendly plastic material is used. The panels can be recycled and reused.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
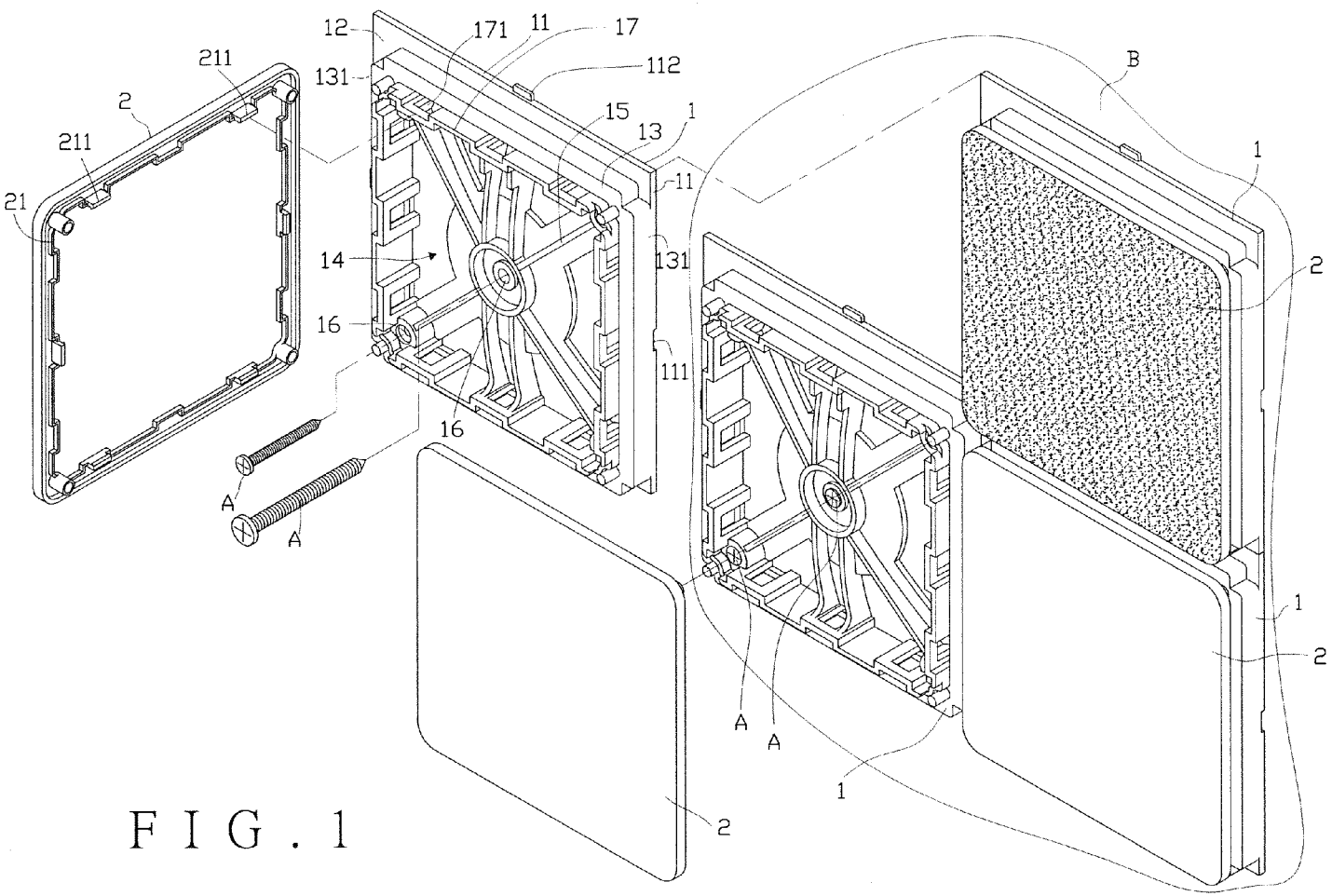
FIG. 1 shows the relative position relationship between parts of the panel assembly of the present invention.
Figure 2:
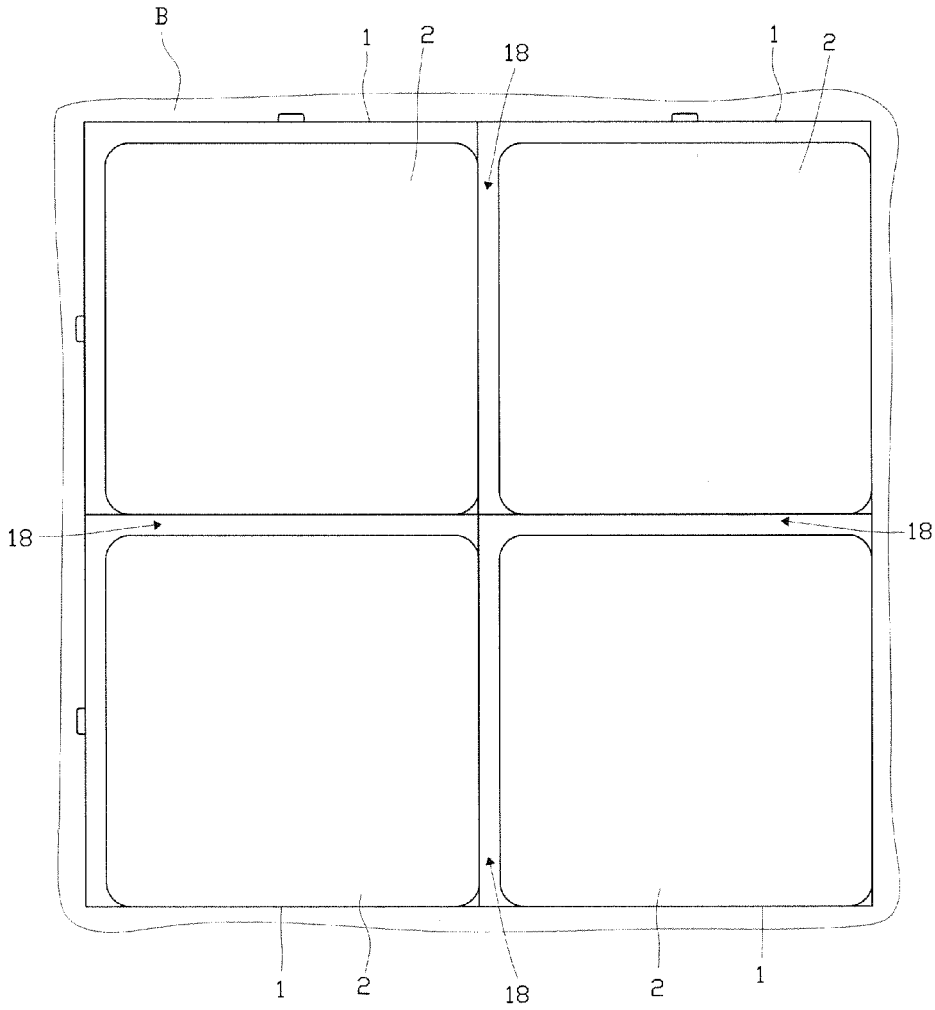
FIG. 2 is a plane view to show the relative position relationship between parts of the panel assembly of the present invention.
Figure 3:
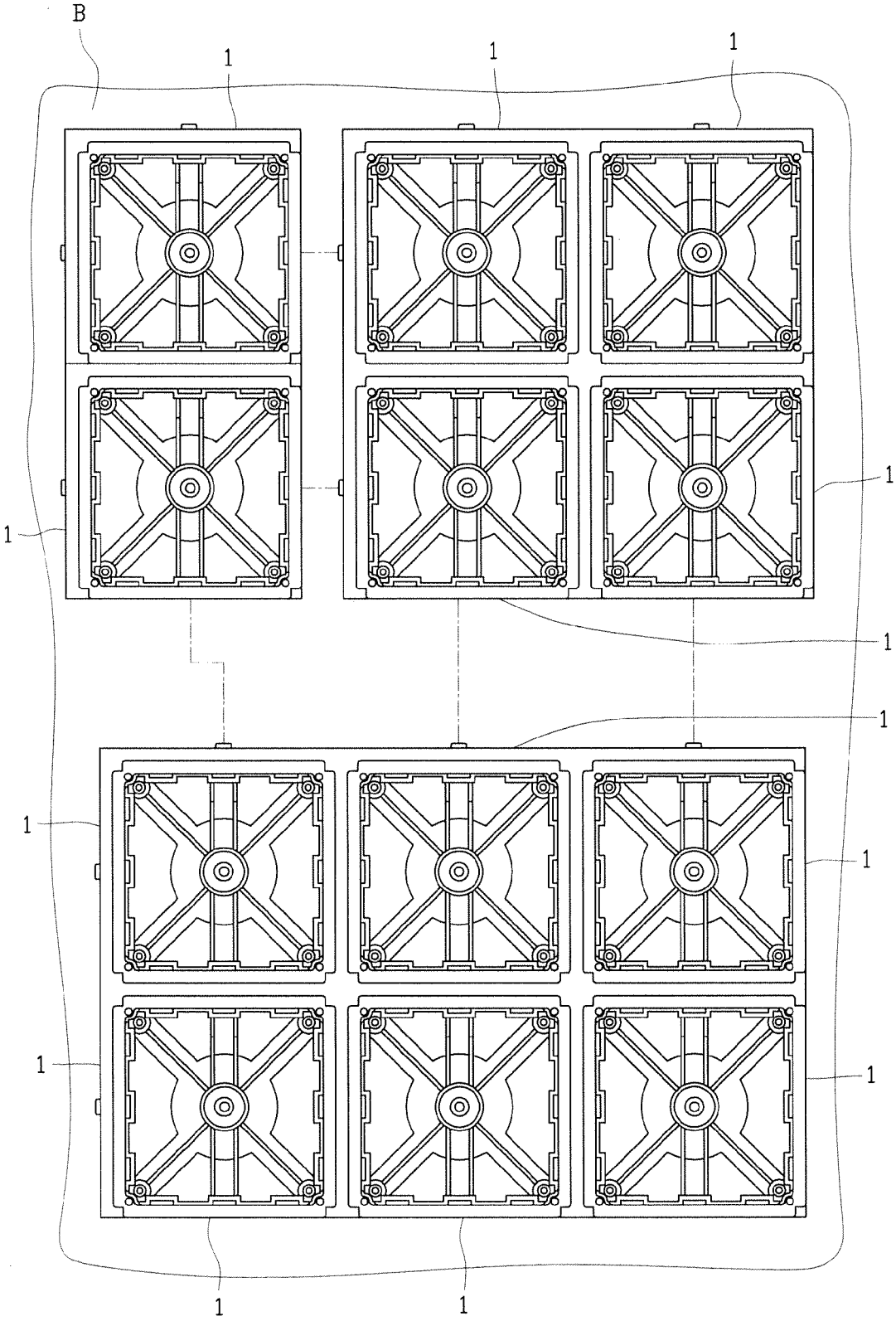
FIG. 3 shows that the multiple base boards are formed integrally.

Referring to FIGS. 1 and 2, the panel assembly of the present invention comprises multiple base boards 1 and each base board 1 has four sides 11 to form a base face 12. A rectangular wall 13 extends from the base face 12 and has a hollow portion 14. A fixing unit 15 is located in the hollow portion 14 and connected to the rectangular wall 13. The fixing unit 15 has more than one fixing holes 16. The base boards 1 can be fixed to a wall "B" by extending screws "A" through the fixing holes 16. A first connection member 17 is located at the conjunction portion between the rectangular wall 13 and the hollow portion 14. The first connection member 17 has a connection hole 171 and a path 18 is defined between two adjacent rectangular walls 13. In this embodiment, the two adjacent sides 131 of the rectangular wall 13 are in flush with the two adjacent sides 11 of the base board 1, so that the path 18 is defined between the other two adjacent sides 11 of the base board 1 and the rectangular wall 13. When assembling the multiple base boards 1, multiple paths 18 are defined between the rectangular walls 13, and this can cover the seams between the adjacent base boards 1 so that the paths 18 are formed seamless. Two adjacent sides 11 of each of the base boards 1 respectively have a positioning notch 111 and the other two adjacent sides 11 of each of the base boards 1 has a positioning ridge 112 which is located corresponding to the positioning notch 111 of another base board 1. Preferably, as shown in FIG. 3, the multiple base boards 1 can be assembled to each other, or the multiple base boards 1 are fixed to each other. The multiple base boards 1 are able to be formed integrally or by using glue or adherent. In this embodiment, four or six base boards 1 are fixed to each other and can be assembled as desired.

Figure 4:
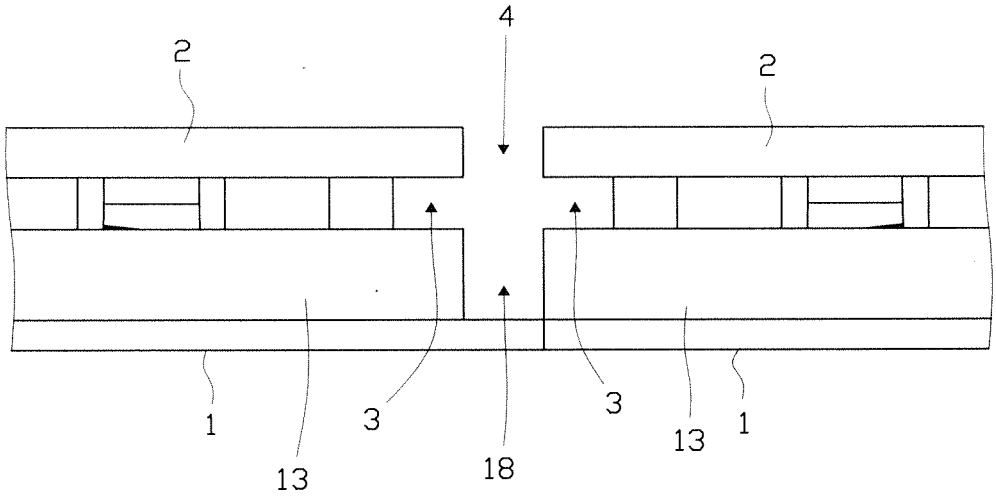
FIG. 4 shows that multiple base boards and multiple cover panels are connected to each other and define cross-shaped paths.

The cover boards 2 may have different colors, patterns or drawings, or the combination of the colors, the patterns and the drawings. There is a second connection member 21 which has a resilient latch 211 and the resilient latch 211 is located corresponding to the more than one connection holes 171 of the first connection member 17. The second connection member 21 of the cover panel 2 is connected to the first connection member 17 of the base board 1. A space 3 is defined between the base board 1 and the cover panel 2, and the space 3 is used to separate the cover panel 2 from the base board 1. A gap 4 is defined between the adjacent cover panels 2 and located corresponding to the path 18. The space 3, the gap 4 and the path 18 define a cross-shaped passage as shown in FIG. 4.

Figure 5:
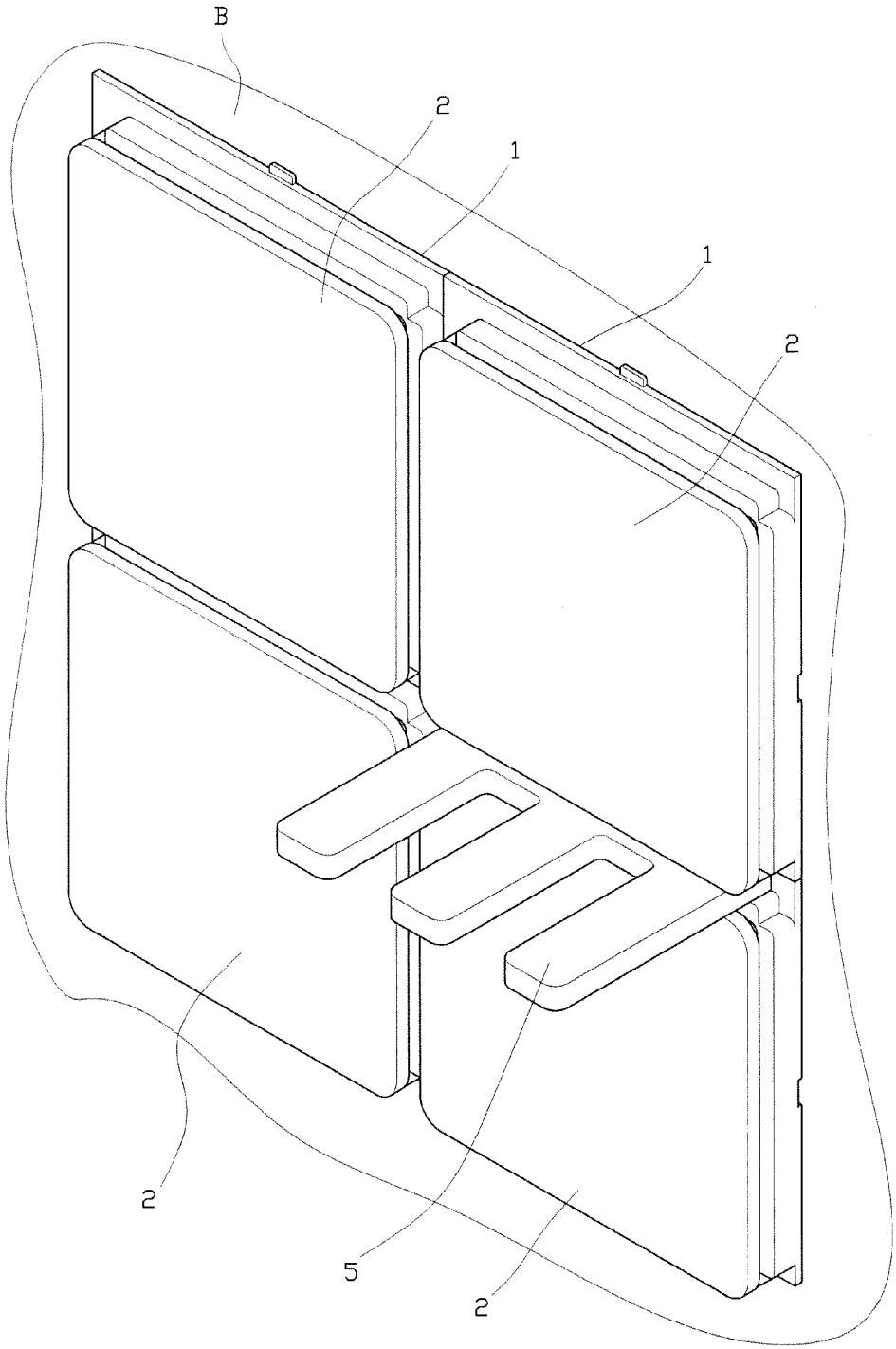
FIG. 5 shows that multiple base boards and multiple cover panels are connected to each other and define cross-shaped paths with which shelves are inserted.

As shown in FIG. 5, a shelve 5 is inserted into the cross-shaped passage and the shape of the shelve 5 is not limited, as long as the shelve 5 is securely inserted into the gap 4 and the path 18. When removing the shelve 5, the shelve 5 is simply removed from the gap 4 and the path 18.

Figure 6:
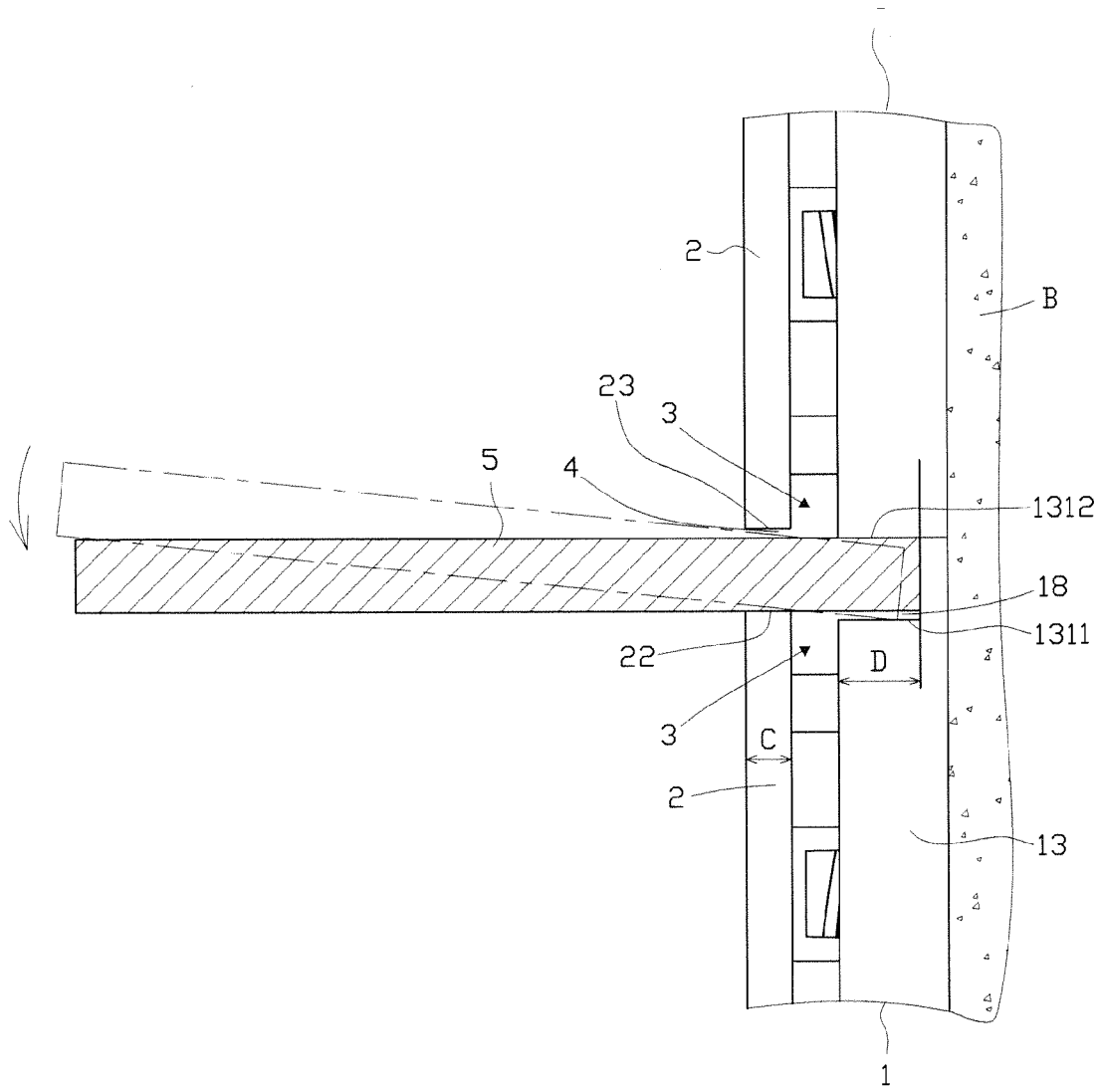
FIG. 6 shows the load arrangement on the shelve and the shelve is perpendicular to the cover panel.

As shown in FIG. 6, the path 18 and the gap 4 between the adjacent base board 1 and the cover panel 2 are slightly larger than the thickness of the shelve 5 so that when the shelve 5 is inserted into the cross-shaped passage, the shelve 5 is slightly inclined downward. In order to improve this problem, the top edge 22 of the lower cover panel 2 protrudes beyond the top side 1311 of the rectangular wall 13, and the bottom edge 23 of the top cover panel 2 is shrank relative to a bottom side 1312 of the rectangular wall 13. The gap 4 between the adjacent upper and lower cover panels 2 is shifted a distance from the path 18 between the adjacent upper and lower rectangular walls 13. Therefore, the shelve 5 can be inserted into the path 18 inclinedly and contacts the top edge 22 of the lower cover panel 2 and the bottom side 1312 of the rectangular wall 13 of the top base board 1. The shelve 5 is substantially perpendicular to the cover panel 2. It is noted that the way that the shifted distance is not limited, in this embodiment, the shifted distance is achieved by shrinking the top side 1311 of the rectangular wall 13 and by extending the bottom side 1312 of the rectangular wall 13. Different ways such as extending the top edge 22 of the cover panel 2 and shrinking the bottom edge 23 of the cover panel 2, or by shifting the cover panel 2 and the base 1 may also available.

As shown in FIG. 6, when the bottom side 1312 of the rectangular wall 13 is located close to the top edge 22 of the cover panel 2, the combination can bear heavier load. The thickness "C" of the cover panel 2 is smaller than the thickness "D" of the rectangular wall 13. The load of the shelve 5 can be supported by the rectangular wall 13 to reduce the load applied to the cover panel 2 and avoid the cover panel 2 from being deformed.

Figure 7:
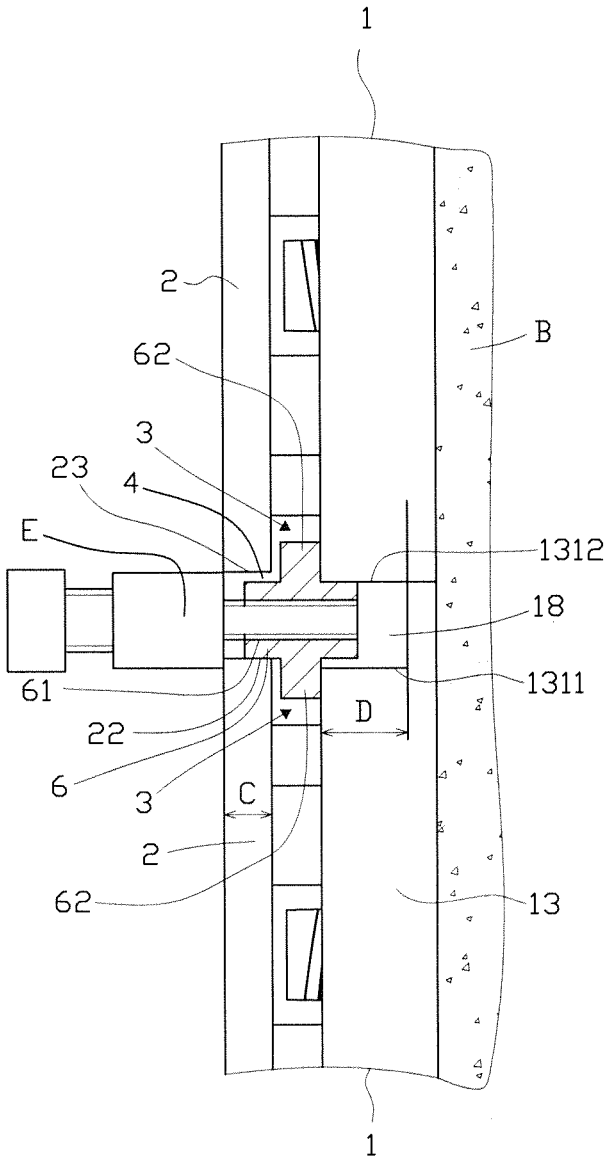
FIG. 7 shows that the cross shaped path has a block connected thereto.
Figure 8:
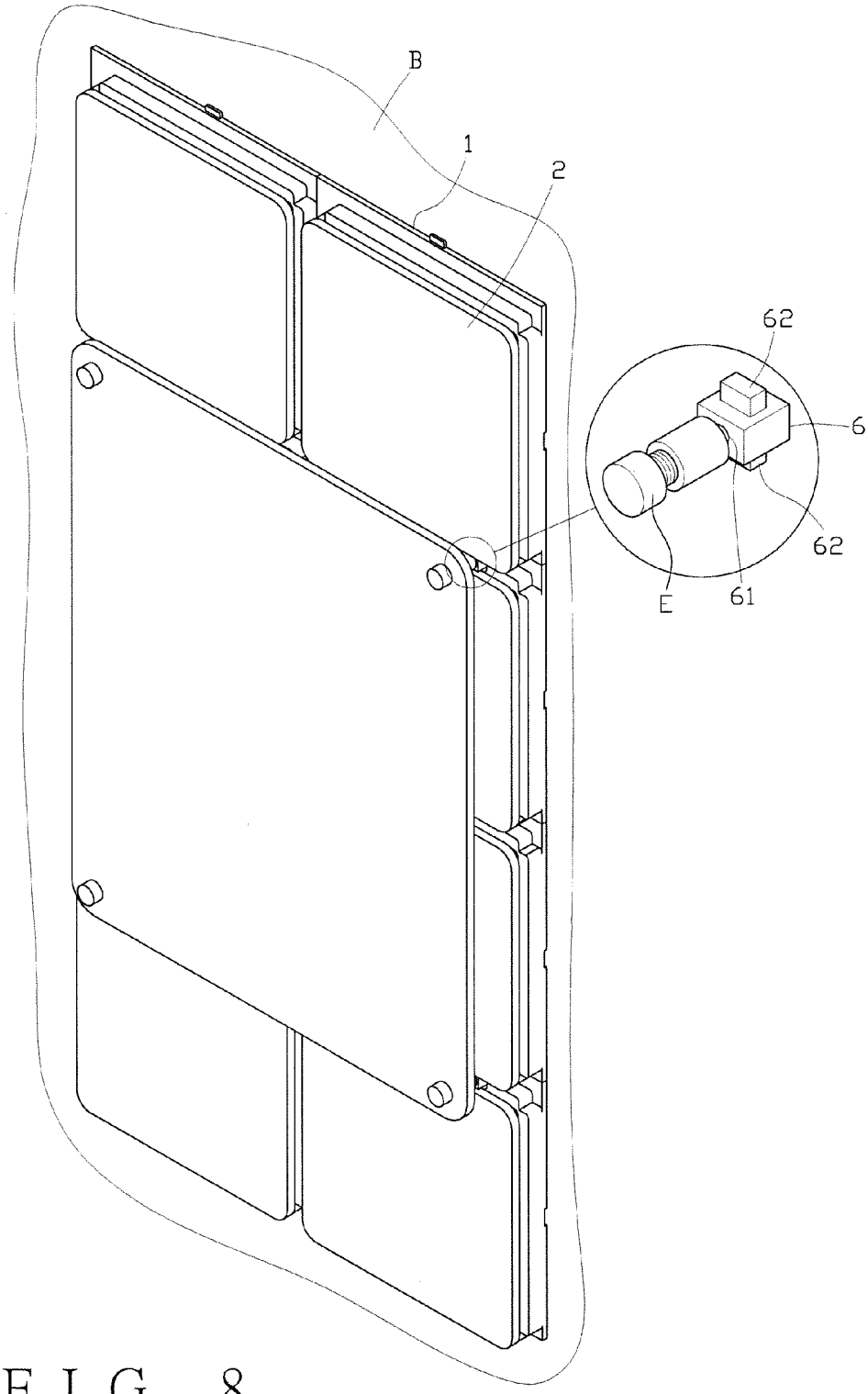
FIG. 8 shows the block is connected to the cover panels.

As shown in FIGS. 7 and 8, a block 6 is received in the cross-shaped passage, and has a threaded hole 61 and two side wings 62. The block 6 is located between the gap 4 and the path 18, and the side wings 62 are located in the space 3. A bolt "E" extends through the threaded hole 61 to fix the block 6 in the passage and the bolt "E" protrudes from the cover panel 2. Other accessories such as hooks, rods or boards can be hanged to the bolt "E".

Figure 9:
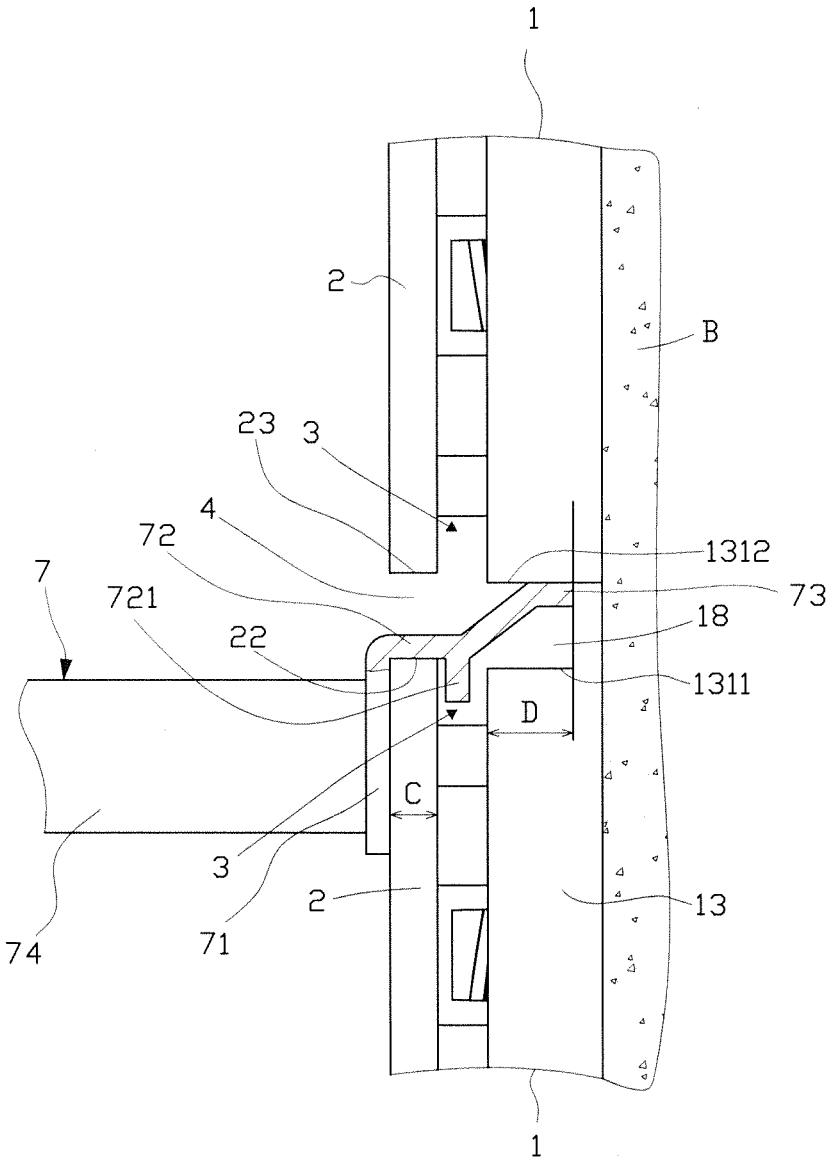
FIG. 9 shows that the cross shaped path has accessories connected thereto.
Figure 10:
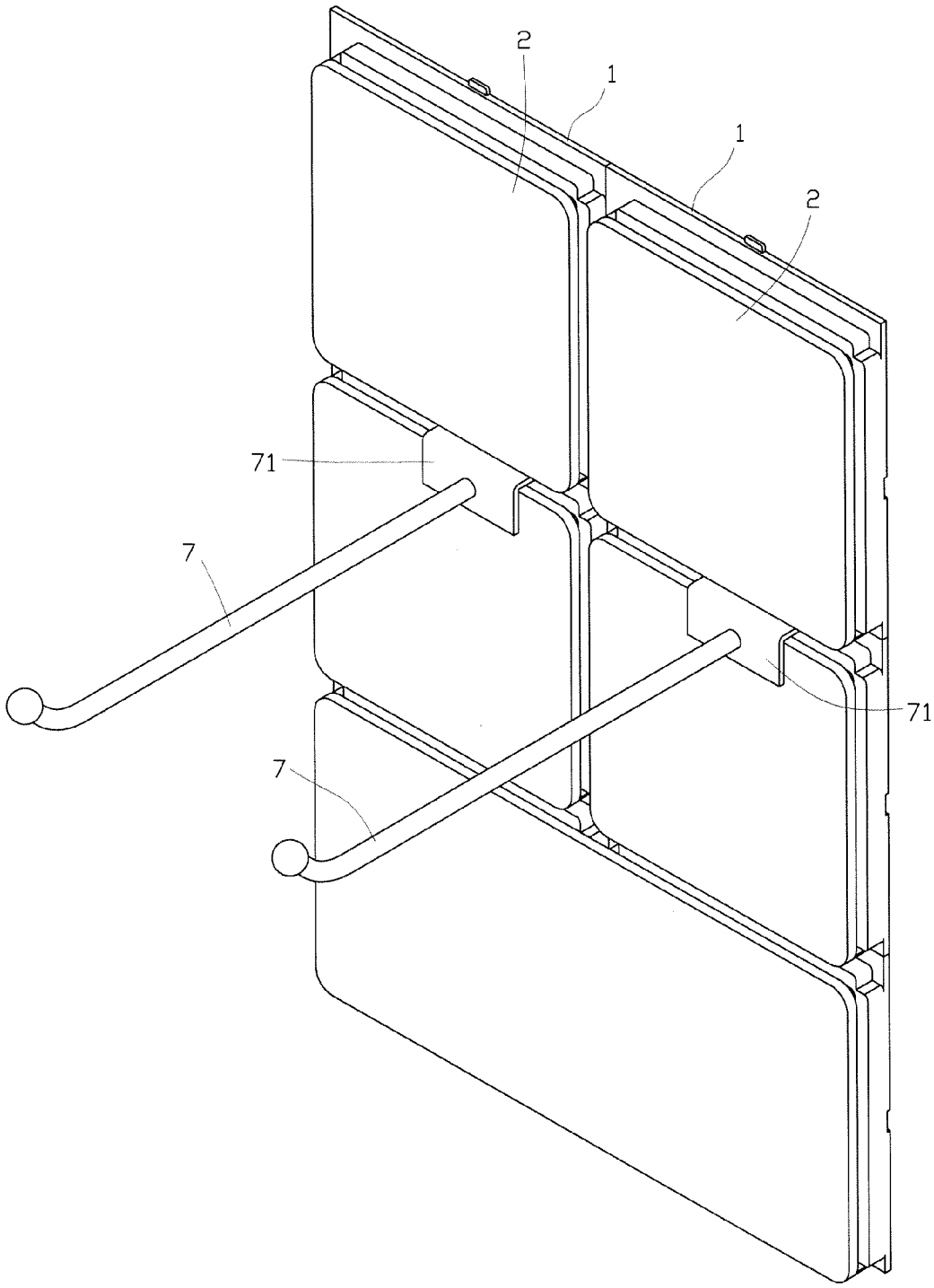
FIG. 10 shows that one embodiment of the accessories cooperated with the panel assembly.

As shown in FIGS. 9 and 10, an accessory 7 is received in the cross-shaped passage and comprises a first accessory portion 71, a second accessory portion 72 and a third accessory portion 73. An included angle of 90 degrees is defined between the first accessory portion 71 and the second accessory portion 72. The second accessory portion 72 is connected to the third accessory portion 73, and the first accessory portion 71 contacts the cover panel 2. A rod 74 extends from one side of the first accessory portion 71. The second accessory portion 72 is located in the gap 4 and the path 18. The third accessory portion 73 contacts the rectangular wall 13. Objects can be hanged to the rod 74. In order to prevent the accessory 7 from being disengaged from the cross-shaped passage, the second accessory portion 72 has a protrusion 721 located in the space 3. By the protrusion 721 in the space 3, the accessory 7 can be avoided from being disengaged from the cross-shaped passage.

Figure 11:
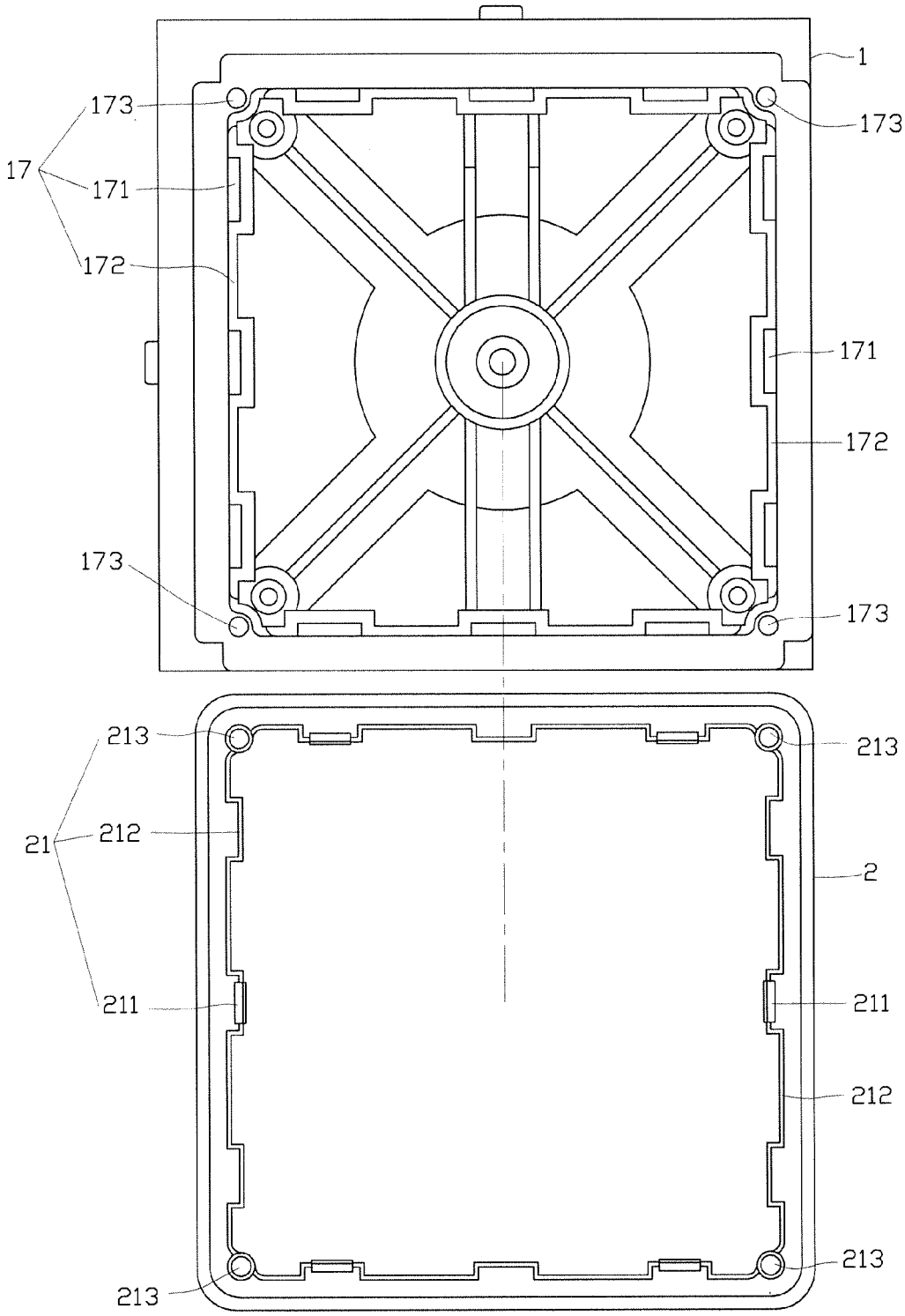
FIG. 11 shows that the base boards and the cover panels have positioning ribs and positioning rods and positioning holes so that the cover panels can be fixed to the base boards.

As shown in FIG. 11, in order to precisely and firmly connect the cover panel 2 to the base board 1, the first and second connection members 17, 21 have positioning ribs 171/212, and a positioning rod 173 and a positioning hole 213. By the reinforcement to the connection between the panel 2 and the base board 1, when a heavy load is applied, the panel 2 is not disengaged from the base board 1.

Figure 12:
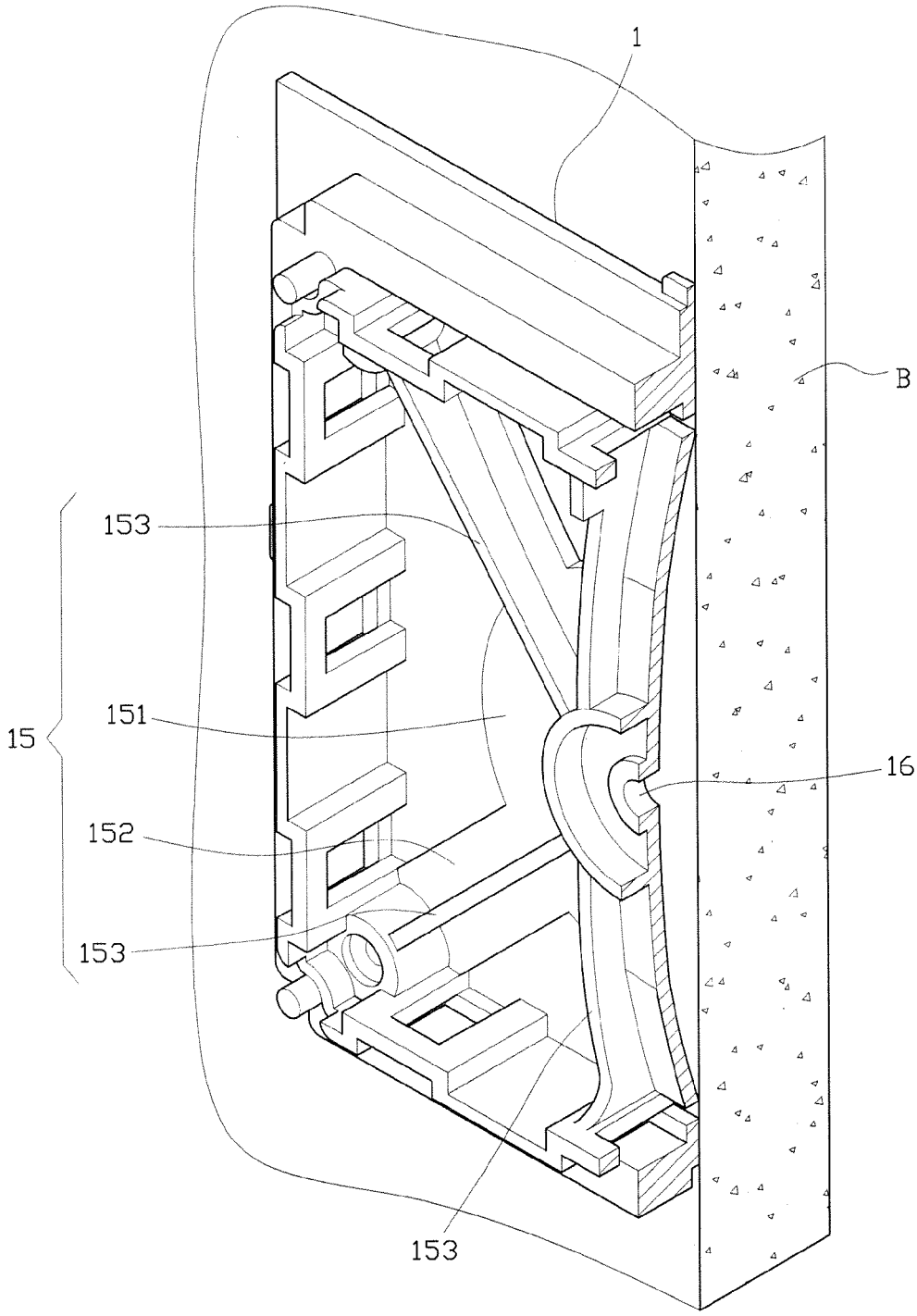
FIG. 12 shows the fixing unit of the present invention.
Figure 13:
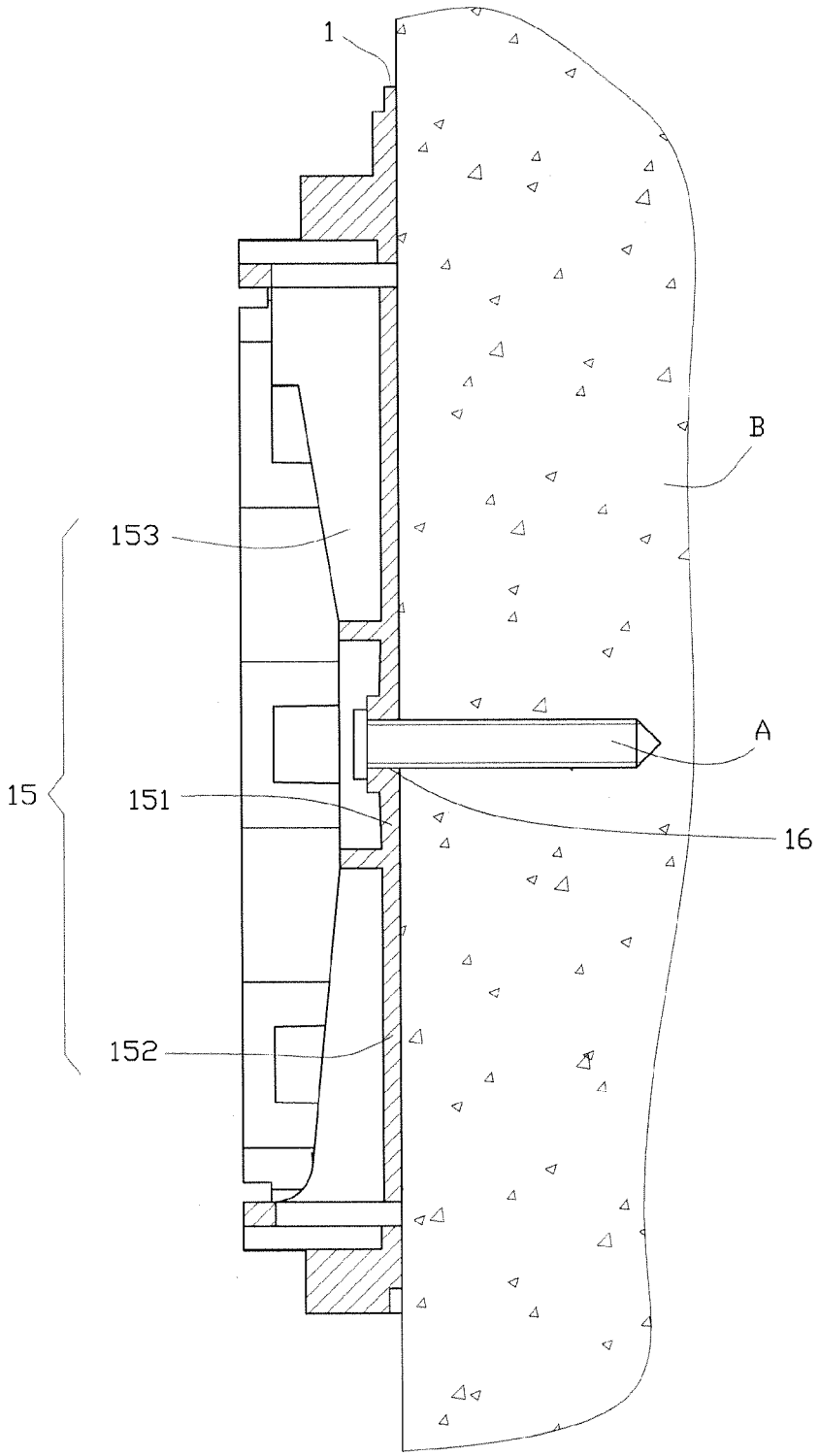
FIG. 13 shows that the fixing unit is fixed to a wall.

As shown in FIGS. 12 and 13, in order to reinforce the connection between the base board 1 and the wall "B", the fixing unit 15 has a fixing member 151 which extending to the multiple connectors 152. The connectors 152 are connected to the fixing member 151 and extend to the rectangular wall 13. The fixing member 151 and the connectors 152 each have a reinforcement rib 153. The fixing hole 16 is located at the center of the fixing member 151. The fixing unit 15 has a curved surface whose highest point is located at the fixing hole 16. When the screw "A" extends through the fixing hole 16 and is fixed to the wall "B", by the pushing force from the screw "A", the fixing member 151 moves toward the wall "B" and the force is transferred to the base board 1 via the connector 152, so that the base board 1 is firmly fixed to the wall "B".

Figure 14:
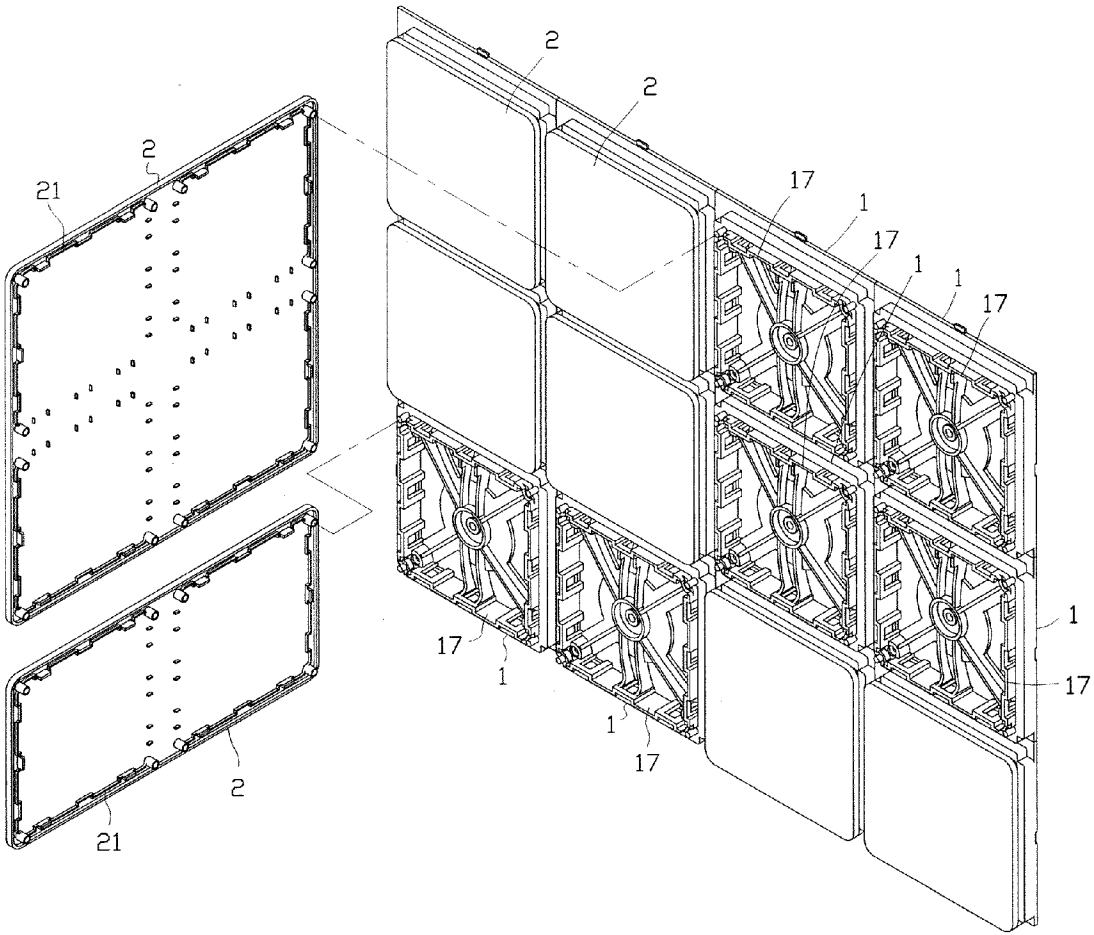
FIG. 14 shows that the cover panels have different sizes.
Figure 15:
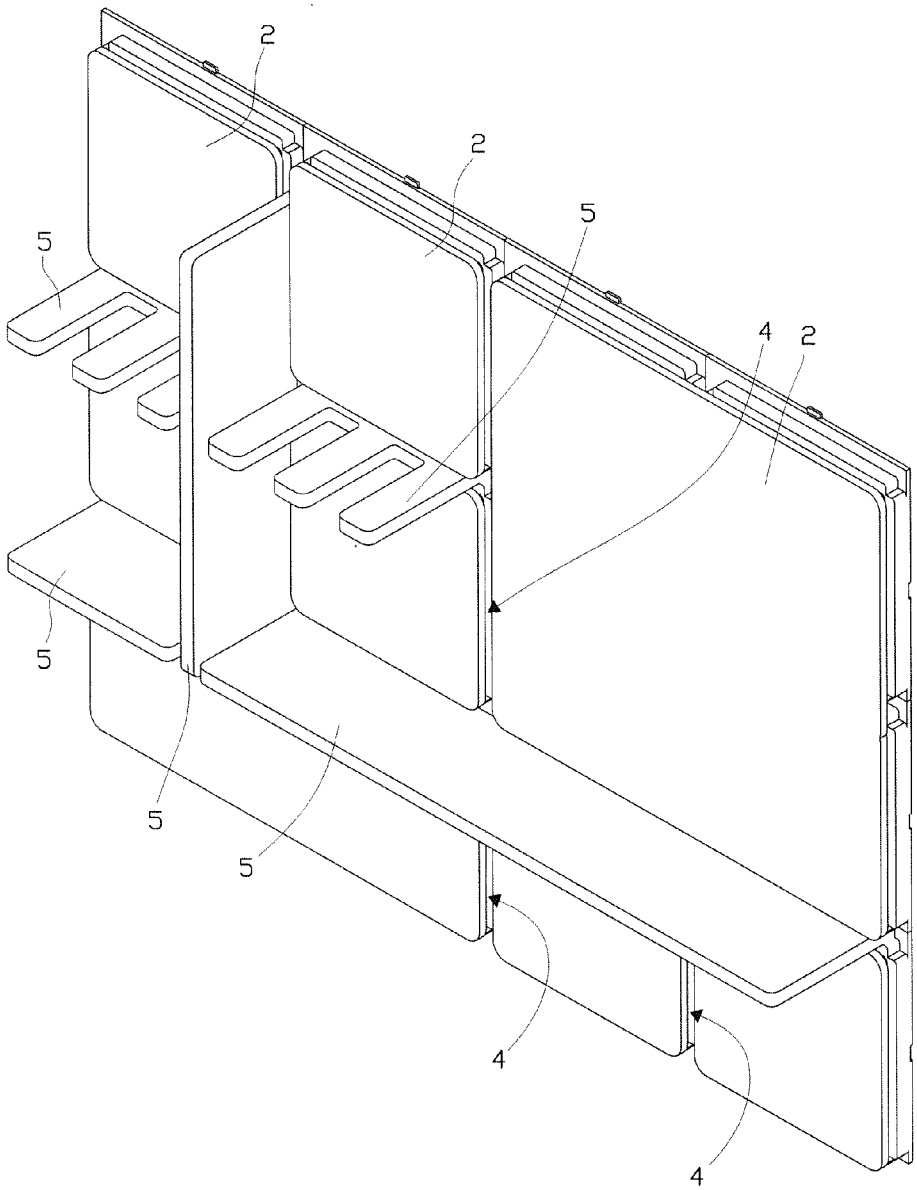
FIG. 15 shows that the covers panels are arranged in different ways to be connected with the shelves.

As shown in FIGS. 14 and 15, in order to combine the multiple shelves 5 to form a specific form, the cover panels 2 are made to have different sizes. The second connection member 21 of the face panel 2 is located corresponding to one or more than one of the first connection members 17. The second connection member 21 of the face panel 2 is located corresponding to the first connection members 17. In this embodiment, the cover panel 2 and the second connection member 21 are located corresponding to two and four first connection members 17 respectively. By different sizes of the cover panels 2, different gaps 4 are obtained so that the shelves 5 are able to be installed as desired. The combinations of the shelves 5 and the cover panels 2 are changeable and adjustable.

Figure 16:
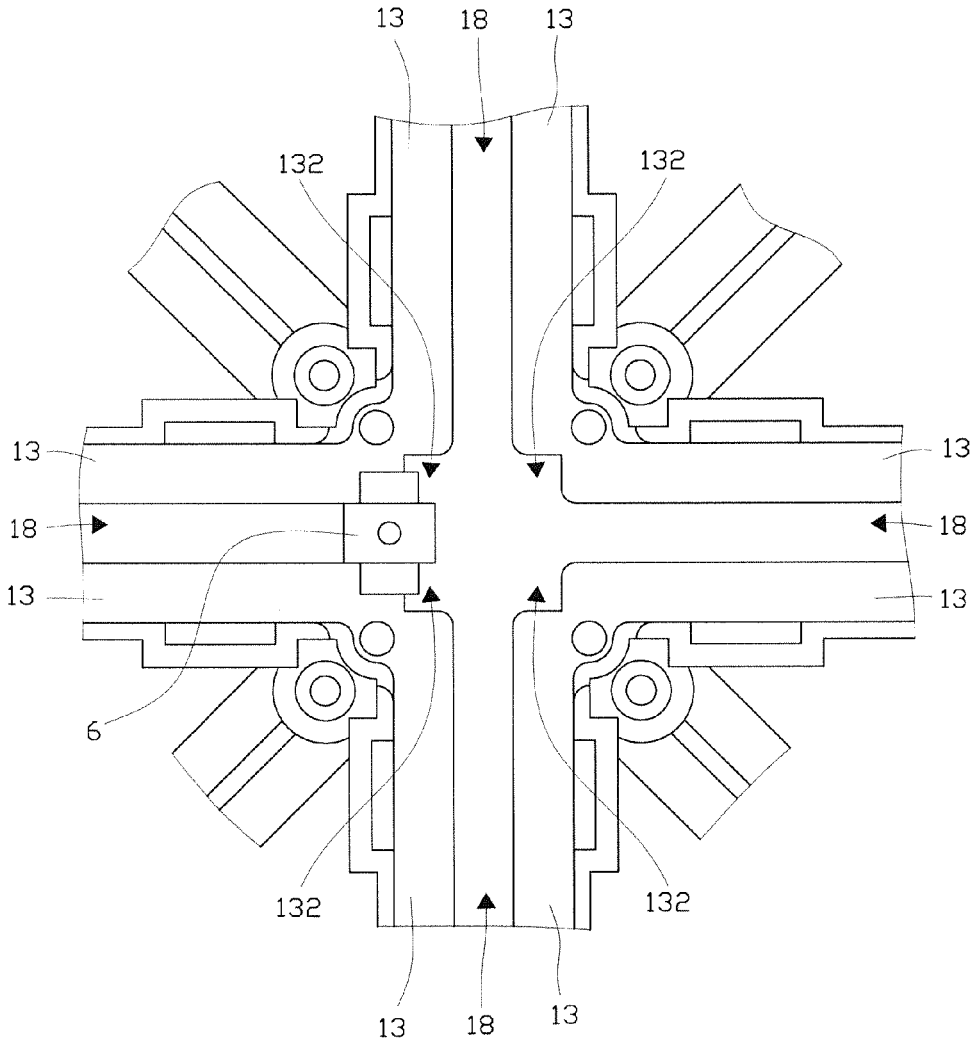
FIG. 16 shows that the rectangular walls have recesses and the cover panels have guide portions so that the block can be easily installed in the path.

As shown in FIGS. 8 and 16, in order to move the block 6 in the cross-shaped passage, each of four corners of the rectangular wall 13 has a recess 132 and the four corners of the cover panel 2 have guide portions so that the recess 132 communicates with the path 18 and the block 6 can be easily moved within the cross-shaped passage.

The panel assemblies are assembled to form different types of applications and are modularized. Environmental friendly plastic material is used. The boards and panels can be recycled and reused. The surface of the panels can be added with printed layers, decoration patterns. The cover panels may also be used as liquid crystal display panels or cold-light display panels.

While we have shown and described the embodiment in accordance with the present invention, it should be clear to those skilled in the art that further embodiments may be made without departing from the scope of the present invention.

What is claimed is:

1. A panel assembly comprising:

multiple base boards each having four sides to form a base face, a rectangular wall extending from the base face and a first connection member extending from the rectangular wall, two adjacent sides of the base boards each have a positioning notch, the other two adjacent sides of the base boards each have a positioning ridge which is located corresponding to the positioning notch;

multiple cover panels each have a second connection member which is located corresponding to the more than one first connection members, the second connection members of the cover panels connected to the first connection members of the base boards, a space defined between the base boards and the cover panels, and a path defined between the rectangular walls of two adjacent base boards and a gap defined between two adjacent cover panels, the gap located corresponding to the path, the space, the path and the gap communicating with each other;

wherein the rectangular wall has a hollow portion and a fixing unit is located in the hollow portion and connected to the rectangular wall, the fixing unit has more than one fixing holes, the first connection member is located at a conjunction portion between the rectangular wall and the hollow portion.

2. The panel assembly as claimed in claim 1, wherein two adjacent sides of the rectangular walls are in flush with two adjacent sides of the base boards, the cover panels are exposed from the other two adjacent sides of the base boards and the rectangular walls, the cover panels and the rectangular walls of the adjacent base boards define the path.

3. The panel assembly as claimed in claim 1, wherein a thickness of the cover panel is smaller than a thickness of the rectangular wall.

4. The panel assembly as claimed in claim 1, wherein the first and second connection members have connection holes and resilient latches.

5. The panel assembly as claimed in claim 1, wherein the first and second connection members have positioning ribs.

6. The panel assembly as claimed in claim 1, wherein the first and second connection members have a positioning rod and a positioning hole.

7. The panel assembly as claimed in claim 1, wherein the fixing unit has a fixing member and multiple connectors which are connected to the fixing member and extend to the rectangular wall, the fixing member and the connectors each have a reinforcement rib, the fixing hole is located at a center of the fixing member, the fixing unit has a curved surface whose highest point is located at the fixing hole.

8. The panel assembly as claimed in claim 1, wherein the multiple base boards are fixed to each other.

9. The panel assembly as claimed in claim 8, wherein the multiple base boards are formed integrally or glued to each other.

10. The panel assembly as claimed in claim 1, wherein the multiple base boards are assembled to each other.

11. The panel assembly as claimed in claim 1, wherein the second connection member of the face panel is located corresponding to one of the first connection members.

12. The panel assembly as claimed in claim 1, wherein the second connection member of the face panel is located corresponding to the first connection members.

13. The panel assembly as claimed in claim 1, wherein each of four corners of the rectangular wall has a recess.

14. The panel assembly as claimed in claim 1 further comprising a shelve which is inserted into the gap and the path.

15. The panel assembly as claimed in claim 1, wherein the cover panel has a face facing the second connection member has patterns and drawings or is colored.

16. The panel assembly as claimed in claim 1, wherein the gap between the adjacent upper and lower cover panels is shifted a distance from the path between the adjacent upper and lower rectangular walls, a top edge of the lower cover panel protrudes beyond a top side of the rectangular wall, a bottom edge of the top cover panel is shrink relative to a bottom side of the rectangular wall.

17. The panel assembly as claimed in claim 1 further comprising a block which has a threaded hole and two side wings, the block is located between the gap and the path, and the side wings are located in the space.

18. The panel assembly as claimed in claim 1 further comprising an accessory and the accessory comprising a first accessory portion, a second accessory portion and a third accessory portion, an included angle of 90 degrees defined between the first accessory portion and the second accessory portion, the second accessory portion connected to the third accessory portion, the first accessory portion contacting the cover panel, a rod extending from a side of the first accessory portion, the second accessory portion located in the gap and the path, the third accessory portion contacting the rectangular wall, the second accessory portion having a protrusion located in the space.

* * * * *